United States Patent [19]

Torita et al.

[11] Patent Number: 4,760,783

[45] Date of Patent: Aug. 2, 1988

[54] COMPRESSION APPARATUS HAVING A MAIN COMPRESSION DEVICE AND A TAPERED PRECOMPRESSION DEVICE

[75] Inventors: Katsutoshi Torita, Handa; Kojuro Yamamoto, Inazawa, both of Japan

[73] Assignee: NGK Insulators, Ltd., Aichi, Japan

[21] Appl. No.: 42,786

[22] Filed: Apr. 27, 1987

[30] Foreign Application Priority Data

Jul. 9, 1986 [JP] Japan ..... 61-159552

[51] Int. Cl.[4] ..... B30B 7/00; B30B 15/04; G21F 9/36

[52] U.S. Cl. ..... 100/137; 100/193; 100/209; 100/245; 100/246; 252/626; 252/633

[58] Field of Search ..... 100/41, 42, 295, 245, 100/902, 240, 214, 246, 229 R, 218, 179, 252, 193, 209; 252/626, 633

[56] References Cited

U.S. PATENT DOCUMENTS

| | | | |
|---|---|---|---|
| 3,405,744 | 10/1968 | Bowman | 100/246 X |
| 3,416,439 | 12/1968 | Tezuka | 100/246 X |
| 3,643,590 | 2/1972 | Aluotto | 100/246 X |
| 4,631,015 | 12/1986 | Shigeo et al. | 100/246 |

FOREIGN PATENT DOCUMENTS

| | | |
|---|---|---|
| 0081074 | 6/1983 | European Pat. Off. . |
| 0178802 | 4/1986 | European Pat. Off. . |
| 0198992 | 10/1986 | European Pat. Off. . |

*Primary Examiner*—Andrew M. Falik
*Attorney, Agent, or Firm*—Parkhurst & Oliff

[57] ABSTRACT

A compression and volume reduction treatment apparatus for solid waste comprises a main compression and a pre-compression device. The main compression device includes a compression sleeve for receiving therein a cylindrical vessel filled with the solid waste and a press ram for compressing downward the filled cylindrical vessel. The pre-compression device comprises a pre-compression press ram and a pre-compression tapered sleeve for inserting the cylindrical vessel into the compression sleeve. The cylindrical vessel has an outer diameter larger than an inner diameter of the compression sleeve, while the pre-compression tapered sleeve has at a lowermost end an inner diameter smaller than the inner diameter of the compression sleeve. An inner circumferential surface of the pre-compression tapered sleeve and an outer circumferential surface of the pre-compression press ram are formed with grooves and ridges slidably fitted with each other. With such an arrangement, steel drums together with solid waste are compressed and reduced in volume to form a plurality of compressed blocks which can be stored in a steel drum which has the same size as that of the steel drum compressed together with the waste. An operator is only required to handle steel drums having the same size.

2 Claims, 1 Drawing Sheet

COMPRESSION APPARATUS HAVING A MAIN COMPRESSION DEVICE AND A TAPERED PRECOMPRESSION DEVICE

BACKGROUND OF THE INVENTION

This invention relates to an apparatus for compressing vessels filled with miscellaneous combustible and incombustible solid waste so as to reduce their volume, and more particularly to an apparatus for pressing various solid waste packed into cylindrical vessels, for example, steel drums, so as to reduce their volume in three dimensional directions by uniaxial compression to form reduced volume compacted blocks.

In general, miscellaneous combustible and incombustible solid waste having various shapes and properties are treated by incineration or are compressed to form compacted blocks according to their properties and thereafter are used for reclamation or are again utilized if useful substances are included. Among this solid waste, however, there are some kinds of waste unavoidably stored in places or plants where they are produced because it is impossible to dispose of them, such waste being contaminated by radioactive materials derived from nuclear power installations such as nuclear power stations, nuclear power research installations, nuclear fuel treating installations, nuclear power reprocessing factories, radioisotope treating installations and the like (which will be referred to hereinafter as "radioactive waste"), and waste contaminated by poisonous or toxic substances derived from poisonous material producing or treating processes (which will be referred to hereinafter as "poisonous waste"). In this case, they are usually packed and stored in cylindrical vessels such as steel drums in order to prevent the radioactive or poisonous substances from spattering from the waste and to prevent spread of contaminated areas. As the stored amounts progressively increase, it has been desired to treat combustible waste to reduce their volume by incinerating them in certain installations, and particularly to compress incombustible waste to reduce their volume in certain plants, at least to start studying such processes for the purpose of saving storage space.

Such a compression treatment for waste is the simplest process for reducing volume of the waste and has an advantage in that no secondary waste occurs in this process. In the compression treatment presently carried out in nuclear power stations and the like, after a lid of a steel drum is opened and waste is charged into the steel drum, the waste is compressed to reduce its volume by a press ram having a diameter slightly smaller than an inner diameter of the steel drum. With this processing, there is a risk of radioactive materials spattering to spread the contamination, and particularly, for waste having high restoring ability, the compressed waste is apt to resiliently increase again in volume, so that the expected reduction in volume cannot be achieved.

Moreover, it has been proposed to compress waste together with steel drums filled therewith to reduce their volume. In this case, the steel drum filled with waste is compressed in a cylindrical sleeve in a uniaxial direction or in three dimensional directions. In the uniaxial compression, outer diameters of compressed waste and drums (referred to hereinafter "compressed blocks") are substantially equal to or larger than inner diameter of the original steel drums, so that a new vessel having a larger inner diameter is needed for storing the compressed blocks. This is a disadvantage of the uniaxial compression. In the three dimensional compression, on the other hand, although it does not have such a disadvantage, an apparatus for compression is complicated, bulky and increases the cost of equipment due to compression in the multiple directions.

The present application is related to copending application Ser. No. 026,295 filed Mar. 16, 1987. The copending application discloses a compression and volume reduction treatment apparatus wherein a ram compresses a drum located in a large diameter sleeve through a tapered section and into a small diameter portion. The lowermost portion of the tapered sleeve has a diameter equal to the diameter of the small diameter portion. Applicants discovered that the compressed drum may jam in the small diameter portion since the diameter of the small diameter portion is equal to the smallest diameter of the lowermost portion of the tapered sleeve.

SUMMARY OF THE INVENTION

It is a primary object of the invention to provide a compression and volume reduction treatment apparatus for solid waste, which eliminates all of the disadvantages of the prior art and which is capable of compressing a cylindrical vessel filled with solid waste to reduce its volume only by compression in one direction, thereby obtaining effective handling of waste storage vessels and discarded high efficiency particle air filters (HEPA filters).

It is a further object of the invention to provide a compression and volume reduction treatment apparatus for solid waste, whose overall height is reduced so as to be installed in a narrow room, particularly a room with a low ceiling.

In order to achieve this object, in a compression and volume reduction treatment apparatus for solid waste including a compression device having a compression sleeve for receiving therein a cylindrical vessel filled with the solid waste and a press ram for compressing downward said cylindrical vessel filled with the solid waste, according to the invention the apparatus comprises a pre-compression device, said pre-compression device comprising a pre-compression press ram and a pre-compression tapered sleeve for inserting into said compression sleeve said cylindrical vessel having an outer diameter larger than an inner diameter of said compression sleeve, while said pre-compression tapered sleeve having at a lowermost end an inner diameter smaller than the inner diameter of said compression sleeve, and an inner circumferential surface of said pre-compression tapered sleeve and an outer circumferential surface of said pre-compression press ram being formed with grooves and ridges slidably fitted with each other.

In a preferred embodiment of the invention, the compression device and the pre-compression device are provided on a base on which is provided a slide base for moving the compression sleeve between the compression device and pre-compression device.

According to the invention, before compressing a vessel and waste accommodated therein, the waste and the vessel having an outer diameter larger than an inner diameter of a compression sleeve is compressed and reduced in volume and diameter by means of the pre-compression device comprising the tapered sleeve and the pre-compression press ram. Thereafter, the compressed block is inserted in the compression sleeve, compressed and reduced in diameter by means of the main compression device. Accordingly, outer dimensions or outer diameters of compressed blocks are smaller than those of vessels to be compressed. Moreover, the pre-compression device takes partial charge of compression of the vessels and waste, so that overall height of the apparatus is lower than those of apparatuses of the prior art. With the tapered sleeve having the diameter at the lowermost end smaller than the inner diameter of the compression sleeve, moreover, the cylindrical vessel is sufficiently reduced in diameter so as to be easily inserted into the compression sleeve without jamming of the vessel.

The invention will be more fully understood by referring to the following detailed specification and claims taken in connection with the appended drawing.

BRIEF DESCRIPTION OF THE PREFERRED EMBODIMENT

Figure 1:
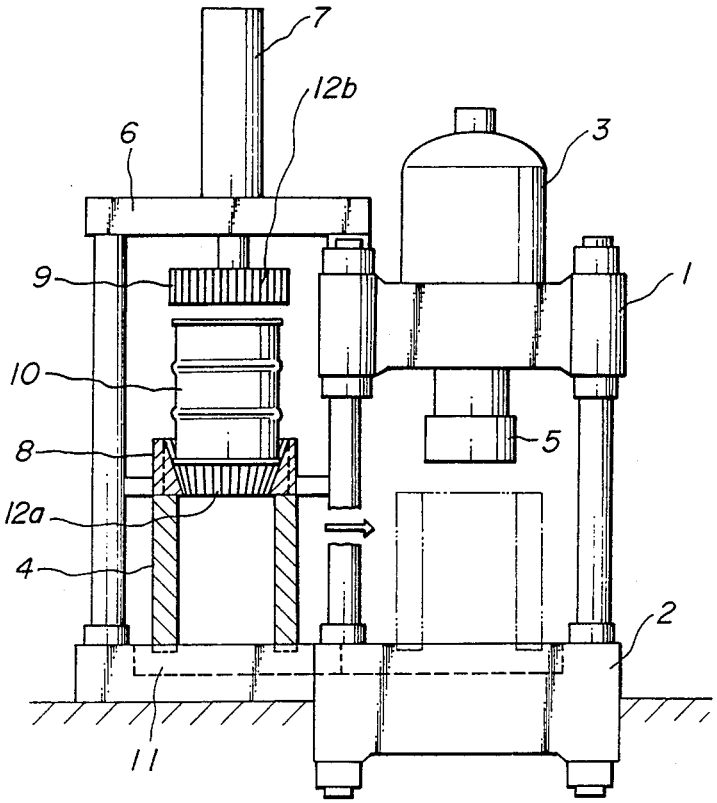
FIG. 1 is a schematic view illustrating one embodiment of the compression and volume reduction treatment apparatus according to the invention.

Referring to FIG. 1 illustrating an embodiment using a steel drum as the vessel for waste, a main compression device comprises a frame 1 rigidly mounted on a base 2 and a hydraulic cylinder 3 having a maximum compressive force of, for example, 1,000 tons, located on the frame 1. Onto a rod of the hydraulic cylinder 3 is mounted a main press ram 5 having an outer diameter engageable with a compression sleeve 4. Moreover, a pre-compression device comprises a pushing press frame 6 provided uprightly on an extension of the base 2. Onto the pushing press frame are fixed a pushing hydraulic cylinder 7 and a tapered sleeve 8 for pre-compression. Onto a rod of the pushing hydraulic cylinder 7 is mounted a pushing press ram 9 for the pre-compression. The tapered sleeve 8 is formed in its inner circumferential surface with a number of longitudinal grooves 12*a* which are slidably fitted with a number of ridges 12*b* formed on an outer circumferential surface of the pushing press ram 9. An inner diameter of the compression sleeve 4 is smaller than an outer diameter of the steel drum 10 for receiving the waste. The tapered sleeve 8 has an inner diameter which is capable of receiving the steel drum 10 and tapered downward terminating at the lower most end in a diameter smaller than an inner diameter of the compression sleeve 4. A slide base 11 is slidably provided on the base 12 along its center and the compression sleeve 4 is located on the slide base 11. By sliding the slide base 11 on the base 2, the compression sleeve 4 is able to assume selectively one position immediately below the main press ram 5 and the other position immediately below the pushing press ram 9 where the compression sleeve 4 is able to contact with tapered sleeve 8.

In this embodiment, the inner diameter of the tapered sleeve 8 at the lower most end is smaller than that of the compression sleeve 4, so that after pre-compression, a compressed block has an inner diameter smaller than that of the compression sleeve 4. Therefore, the compressed block is simply received in the compression sleeve 4 and hence no jamming of the block with the compression sleeve 4 occurs so that a low compression force for the compression in the main compression device is sufficient. Moreover, pre-compressed blocks having diameters smaller than the inner diameter of the compression sleeve 4 can be easily obtained. With the longitudinal grooves 12*a* and ridges 12*b* formed in the inner circumferential surface and the outer circumferential surface, respectively, furthermore, diameters of the vessel or steel drum can easily be reduced so as to permit it to be simply received in the compression sleeve and an obtained compressed block having ridges and grooves formed correspondingly to the grooves 12*a* and ridges 12*b* is easily compressed in the main compression device following thereto. Widths of the grooves 12*a* and the ridges 12*b* are usually of the order of 25 mm, and 10 mm at the minimum.

The procedure for actually carrying out the compression and volume reduction with the apparatus above described will be explained hereinafter. First, the compression sleeve 4 is moved to the position shown in FIG. 1 where the compression sleeve 4 is able to contact the tapered sleeve 8. The steel drum 10 together with waste accommodated therein is located in the tapered sleeve 8 as shown in FIG. 1 and is pressed by the pushing press ram 9 driven by the hydraulic cylinder 7. As a result, the steel drum 10 together with the waste is forced to pass through the tapered sleeve 8 so that the steel drum 10 together with the waste is radially compressed and is forced into the compression sleeve 4 as a pre-compressed block having a smaller diameter. In this case, there are slight clearances between the compression sleeve and the pre-compressed block. When lower ends of the ridges 12*b* of the pushing press ram 9 have arrived at the lower ends of the grooves 12*a* of the tapered sleeve 8, the pushing press ram 9 is raised. Thereafter, the compression sleeve 4 together with the steel drum 10 received therein is brought into the position below the main press ram 5 with the aid of the slide base 11. The main press ram 5 is then lowered by means of the hydraulic cylinder 3 to compress the steel drum 10 further. In order to remove the compressed steel drum 10 together with the waste from the compression sleeve 4, sleeve lifting means (not shown) provided on the main compression device is actuated to raise the compression sleeve 4, while the compressed steel drum 10 and the waste are securely held on the slide base 11 by means of the main press ram 5. In this manner, the compressed steel drum 10 and the waste can be easily removed from the compression sleeve 4, and then removed out of the compression and volume reduction treatment apparatus. However, any suitable method other than that above described may be used for the purpose of removing the compressed steel drum from the compression sleeve 4.

In compressing waste high efficiency particle air filters and reducing their volume produced in nuclear power stations and the like which are different from the vessel filled with the solid waste above described, these waste filters can be treated in the manner above described by replacing the tapered sleeve 8 with another die. After the treatment, compressed blocks can be stored in for example a steel drum having a 200 l capacity.

While the invention has been shown and described with reference to the preferred embodiments, it will be understood that various changes and modifications can be made therein. Although the compression sleeves have been shown in circular cross-section, this is only by way of example, and they may be in section polygonal such as quadrilateral or hexagonal. In this case, compressed blocks of solid waste can be formed in sizes smaller than polygons circumscribed to outer shapes of initial steel drums, thereby improving the storage efficiency of the compressed blocks. Although diameters of the pushing press ram have not been defined in the above embodiment, the diameters of the pushing press ram are preferably larger than those of bodies to be compressed or outer diameters of steel drums for waste.

As can be seen from the description in detail, with the compression and volume reduction treatment apparatus for solid waste according to the invention, by adding a simple pre-compression device to an existing uniaxial compression device, cylindrical vessels such as steel drums of 200 l together with waste are compressed and reduced in volume to form a plurality of compressed blocks which can be stored in a steel drum of 200 l which has the same size as that of the steel drum compressed together with the waste. Accordingly, there is a great advantage in that an operator simply handles steel drums having the same size only. Moreover, waste high efficiency particle air filters can be treated only by simply replacing part of the compression sleeve with a die. In this case a plurality of compressed blocks can be stored in, for example, a steel drum of 200 l. With the apparatus according to the invention, the small sized compression sleeve suffices to bring about the significant effects aimed in the invention, so that the apparatuses can be advantageously installed in a narrow room, particularly a room with a low overhead ceiling.

What is claimed is:

1. A compression and volume reduction treatment appartatus for solid waste comprising a compression device having a compression sleeve for receiving therein a cylindrical vessel filled with solid waste and a press ram for compressing downward said cylindrical vessel filled with solid waste, said apparatus further comprising a pre-compression device, having a pre-compression press ram and a pre-compression tapered sleeve, said cylindrical vessel having an outer diameter larger than an inner diameter of said compression sleeve, said pre-compression tapered sleeve having at a lowermost end an inner diameter smaller than the inner diameter of said compression sleeve, an inner circumferential surface of said pre-compression tapered sleeve and an outer circumferential surface of said pre-compression press ram being formed with grooves and ridges slidably cooperating with each other.

2. A compression and volume reduction treatment apparatus as set forth in claim 1, wherein said compression device and said pre-compression device are provided on a base on which is provided a slide for moving said compression sleeve between said compression device and said pre-compression device.

* * * * *